US011761707B2

(12) United States Patent
Shahrpass et al.

(10) Patent No.: US 11,761,707 B2
(45) Date of Patent: Sep. 19, 2023

(54) EVAPORATIVE WET SURFACE AIR COOLER

(71) Applicant: Alfa Laval Corporate AB, Lund (SE)

(72) Inventors: Kevin Shahrpass, Ransomville, NY (US); Christian Pawlak, Lancaster, NY (US); Christian Andersson, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 215 days.

(21) Appl. No.: 17/133,143

(22) Filed: Dec. 23, 2020

(65) Prior Publication Data

US 2022/0196329 A1 Jun. 23, 2022

(51) Int. Cl.
*F28C 1/14* (2006.01)
*F28D 5/02* (2006.01)

(52) U.S. Cl.
CPC . *F28C 1/14* (2013.01); *F28D 5/02* (2013.01)

(58) Field of Classification Search
CPC ..... F28C 1/14; F28D 5/02; F28D 1/0473
USPC ..... 261/146, 152, 30, 115, DIG. 3, DIG. 43, 261/158
See application file for complete search history.

(56) References Cited

U.S. PATENT DOCUMENTS 2,142,747 A 1/1939 Fisher
2,663,549 A * 12/1953 Otten ..... F28D 9/04 165/150
3,659,623 A * 5/1972 Facius ..... F28D 5/02 137/262
4,112,027 A * 9/1978 Cates ..... F28C 1/14 261/DIG. 11
4,141,702 A * 2/1979 deVries ..... B01D 47/06 95/225
4,366,106 A * 12/1982 Benyak ..... F28F 9/0131 165/60
4,546,826 A 10/1985 Zitzmann
5,724,828 A 3/1998 Korenic
6,598,862 B2 7/2003 Merrill et al.
(Continued)

FOREIGN PATENT DOCUMENTS

CN 2890784 Y 4/2007
CN 104606913 A 5/2015
(Continued)

OTHER PUBLICATIONS

European Search Report for European Patent Application No. 21158627.6 dated Aug. 11, 2021.
(Continued)

*Primary Examiner* — Charles S Bushey
(74) *Attorney, Agent, or Firm* — Birch, Stewart, Kolasch & Birch, LLP

(57) ABSTRACT

A wet surface air cooler (WSAC), including an evaporative spiral heat exchanger for flowing a process medium therethrough, a spray system for spraying a cooling medium directly onto the spiral heat exchanger and a fan for causing air to flow through the evaporative spiral heat exchanger, the combination of the sprayed cooling medium onto the evaporative spiral heat exchanger and the air flowing therethrough causes the cooling medium to at least partially evaporate to lower the temperature of the process medium.

19 Claims, 5 Drawing Sheets

(56) References Cited

U.S. PATENT DOCUMENTS

| | | | | |
|---|---|---|---|---|
| 6,766,655 | B1 * | 7/2004 | Wu | F28B 1/06 165/110 |
| 7,484,718 | B2 * | 2/2009 | Facius | F28F 25/12 261/153 |
| 9,057,563 | B2 | 6/2015 | Carter et al. | |
| 9,279,619 | B2 * | 3/2016 | Aaron | F28D 7/087 |
| 10,260,816 | B2 | 4/2019 | Calton | |
| 11,029,093 | B2 * | 6/2021 | Shin | F28F 27/003 |
| 2005/0039892 | A1 | 2/2005 | Calton et al. | |
| 2006/0168981 | A1 * | 8/2006 | Mager | F28D 5/02 62/310 |
| 2006/0179866 | A1 | 8/2006 | Ting | |
| 2006/0197241 | A1 * | 9/2006 | Brenneke | F28D 5/02 261/109 |

FOREIGN PATENT DOCUMENTS

| | | | |
|---|---|---|---|
| CN | 108278767 | A | 7/2018 |
| CN | 108332453 | A | 7/2018 |
| IT | 20 090 159 | A1 | 4/2011 |

OTHER PUBLICATIONS

Written Opinion and ISR for PCT/EP2021/085953 dated Feb. 11, 2022.

* cited by examiner

EVAPORATIVE WET SURFACE AIR COOLER

1. FIELD OF INVENTION

The present invention is directed to a wet surface air cooler (WSAC) having reduced cost, reduced footprint and improved thermal performance.

2. DESCRIPTION OF THE BACKGROUND ART

Existing evaporative cooling technologies, such as existing wet surface air coolers for industrial applications, have a large footprint and high operating cost.

A traditional wet surface air cooler (WSAC) (e.g., evaporative cooler) is comprised of a tube bundle for facilitating process fluid flow, a spray system that distributes water over a top of the tube bundle, and a fan or a set of fans that pulls air through the tube bundle. The air/spray water mixture on the outside surfaces of the tubes provides an evaporative cooling effect that removes heat from the process fluid and then rejects the heat out of both the fan stack and back into a spray water collection basin.

For instance, U.S. Pat. No. 6,598,862 (herein "862 patent"), which is incorporated by reference in its entirety, discloses an evaporative cooler including a direct heat transfer section 324 separated from an indirect cooling section or indirect heat transfer section 330 by a wall 369, the wall 369 extending to a liquid collector 338 (e.g., a basin), and the liquid collector 338 collecting water ejected from nozzles 344 of the direct heat transfer section 324 and water ejected from nozzles 382 of the indirect cooling section 330. Pumps 362 and 376 are provided for recirculating water from the liquid collector 338 to respective nozzles 382, 344 (862 Patent FIG. 7 and column 13, lines 31-39). Further, the 862 Patent discloses that the direct heat transfer section 324 includes a wet deck fill 326, a drift eliminator 352 and "the air flows in through air inlets 348 and up through the fill 326 to pass through the drift eliminator 352 and past the air moving device 328 to exit through the opening 350" (862 patent FIG. 7, column 12, lines 59-62 and column 14, lines 1-6). The 862 Patent discloses that it is desired to have the coil 332 outside of the air flow, which is achieved by the wall 369, such that "the heat transfer coil 332 is positioned substantially outside of the flow of air through the housing" to reduce the need for additional flow requirements and reduce the need for "extra air moving horsepower" (862 Patent column 2, lines 29-32 and column 14, lines 1-3).

SUMMARY OF THE INVENTION

The present invention is directed to utilizing a spiral type heat exchanger for a wet surface air cooler, in combination with evaporative cooling technology, to provide a more efficient and compact solution to industrial cooling applications.

The present invention enhances the evaporative cooling process of the WSAC by utilizing an evaporative spiral (i.e., spiral shaped) heat exchanger in place of a tube bundle, where the evaporative spiral type heat exchanger is exposed to evaporative cooling. A cooling medium, such as water, is sprayed on the outside heat transfer surfaces of the evaporative spiral heat exchanger and air is either pushed or pulled, via a fan, through open passageways in the evaporative spiral heat exchanger to produce an evaporative cooling effect.

The present invention is operable in both co-current and counter-current arrangements with respect to the direction of air flow through the evaporative spiral heat exchanger and the direction of the sprayed cooling medium, depending on how the fan is positioned. The present invention may further comprise a direct heat exchange section comprised of cooling tower fill to cool the spray water down and provide further increase to the heat transfer efficiency.

A wet surface air cooler (W SAC) includes an evaporative spiral heat exchanger including a first channel configured to receive a process medium, a spray system configured to spray a cooling medium onto the spiral heat exchanger, and a fan configured to force air to flow through the evaporative spiral heat exchanger, wherein the combination of the sprayed cooling medium onto the evaporative spiral heat exchanger and the air flowing through the evaporative spiral heat exchanger causes the cooling medium to at least partially evaporate to cause a temperature of the process medium to decrease.

The first channel of the evaporative spiral heat exchanger may have a spiral shape and include a plurality of winds for flowing the process medium, the evaporative spiral heat exchanger may further include a set of second channels extending axially through the evaporative spiral heat exchanger for receiving air and cooling medium, and each second channel may be provided between winds of the first channel.

The first channel may be a closed path extending between an inlet and an outlet and is closed at top and bottom surfaces of the evaporative spiral heat exchanger, and the second channels may be open at the top and bottom surfaces of the evaporative spiral heat exchanger.

The inlet may be provided at a radial center of the evaporative spiral heat exchanger and the outlet may be provided at an outermost radial surface of the evaporative spiral heat exchanger, or the inlet may be provided at the outermost radial surface of the evaporative spiral heat exchanger and the outlet may be provided at the radial center of the evaporative spiral heat exchanger.

The evaporative spiral heat exchanger may have a cross-flow arrangement in which a direction of air and/or the cooling medium flowing through the second channels is perpendicular to a direction of the process medium flowing through the first channel.

The WSAC may further comprise a lower housing including a plurality of airflow passages and a basin, the basin may be configured to receive the cooling medium sprayed by the spray system.

The airflow passages of the lower housing may be configured to allow air to flow from inside of the WSAC to outside of the WSAC or from outside of the WSAC to inside of the WSAC.

The fan may be provided above the evaporative spiral heat exchanger, and the evaporative spiral heat exchanger may be provided on the lower housing.

The lower housing may be a lower module, and the fan and the spray system may be part of an upper module, and the upper module may be configured to be removably fastened to an upper surface of the evaporative spiral heat exchanger and the lower module may be configured to be removably fastened to a lower surface of the evaporative spiral heat exchanger.

The fan, the spray system and the evaporative spiral heat exchanger may be stacked in a vertical direction.

The spray system may be a concentric spray system including a plurality of distribution channels that are spaced from one another to distribute the cooling medium over the evaporative spiral heat exchanger.

The fan may be horizontally spaced from the evaporative spiral heat exchanger.

The WSAC may further comprise a lower housing including a basin, the basin may be configured to receive the cooling medium sprayed by the spray system, the fan and the evaporative spiral heat exchanger may be provided on a top surface of the basin, and the spray system may be provided above the evaporative spiral heat exchanger.

The fan may be configured to force air across the basin and through the evaporative spiral heat exchanger or through the evaporative spiral heat exchanger and across the basin.

A method of cooling with a wet surface air cooler (WSAC), the WSAC may comprise an evaporative spiral heat exchanger including a first channel configured to receive a process medium, a spray system configured to spray a cooling medium onto the spiral heat exchanger, and a fan configured to force air to flow through the evaporative spiral heat exchanger, the method may comprise flowing the process medium through the first channel, and simultaneously spraying, by the spray system, the cooling medium and operating the fan to flow air through the evaporative heat exchanger and cause the cooling medium to at least partially evaporate and cause a temperature of the process medium to decrease.

The first channel of the evaporative spiral heat exchanger may have a spiral shape and includes a plurality of winds for flowing the process medium, and the evaporative spiral heat exchanger may further include a set of second channels extending axially through the evaporative spiral heat exchanger, each second channel is provided between winds of the first channel, the method further comprising, during the simultaneously spraying the cooling medium and operating the fan, flowing the cooling medium and air through the second channels in a same direction or in opposite directions.

The first channel may be a closed path extending between an inlet and an outlet and is closed at top and bottom surfaces of the evaporative spiral heat exchanger, and the second channels may be open at the top and bottom surfaces of the evaporative spiral heat exchanger, said method may further comprise flowing the process medium from a center of the evaporative spiral heat exchanger, radially outwardly through the first channel to an outer surface of the evaporative spiral heat exchanger, allowing the cooling medium to flow downwardly through gravity, and forcing the air upwardly, opposite to the direction of the cooling medium.

The first channel may be a closed path extending between an inlet and an outlet and may be closed at top and bottom surfaces of the evaporative spiral heat exchanger, and the second channels may be open at the top and bottom surfaces of the evaporative spiral heat exchanger, the method may further comprise flowing the process medium from an outer surface of the evaporative spiral heat exchanger, radially inwardly through the first channel to a center of the evaporative spiral heat exchanger, allowing the cooling medium to flow downwardly through gravity, and forcing the air upwardly, opposite to the direction of the cooling medium.

The fan and the spray system may be part of an upper module, and the WSAC may further comprise a lower module including a plurality of airflow passages and a basin, the method may further comprise removably fastening the upper module to an upper surface of the evaporative spiral heat exchanger and removably fastening the lower module to a lower surface of the evaporative spiral heat exchanger.

The spiral heat exchange of the present invention provides more efficient heat transfer and thus require less surface area, resulting in a more compact WSAC with a drastically reduced footprint over a traditional WSAC.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
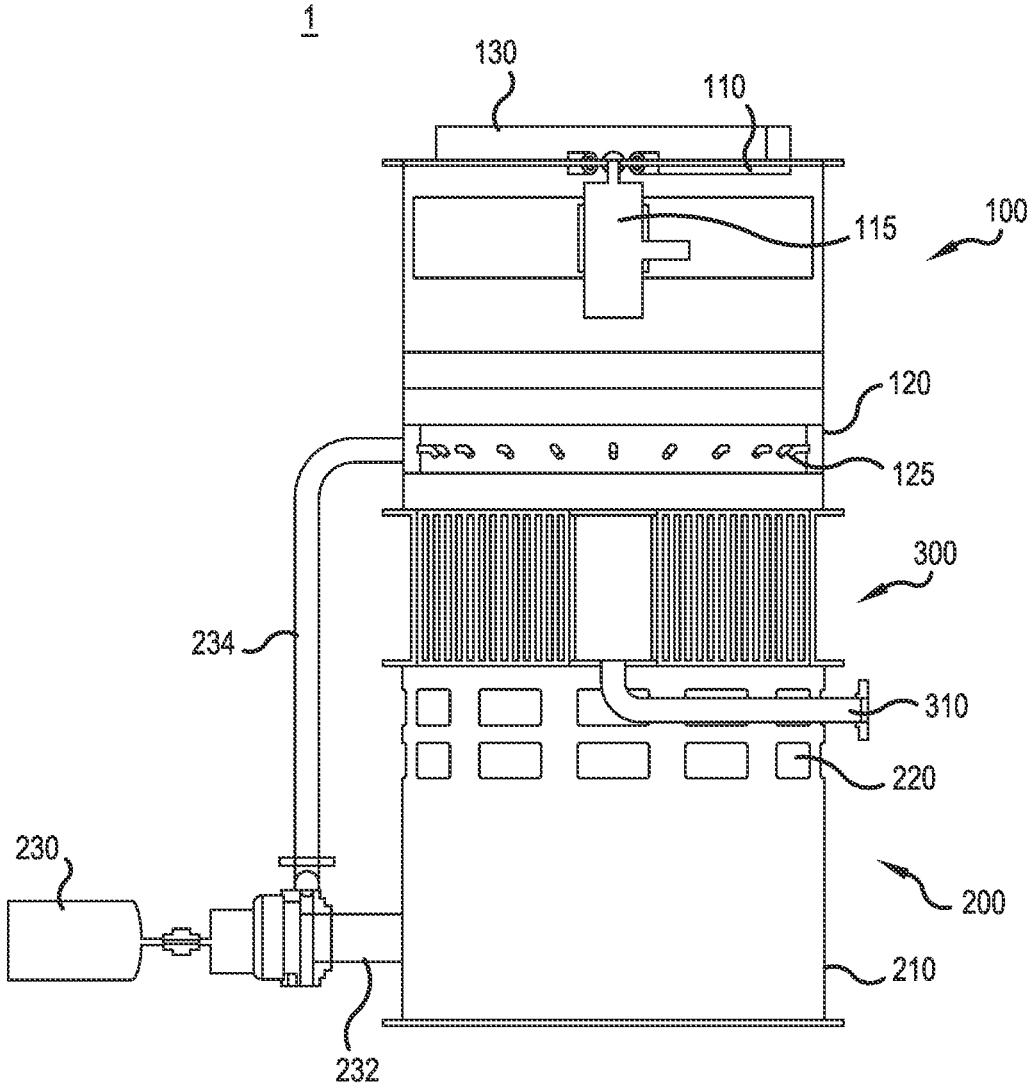
FIG. 1 is a cross-sectional view of the WSAC according to an embodiment of the present invention.

The present invention will now be described with reference to the accompanying drawings, wherein the same reference numerals have been used to identify the same or similar elements throughout the several views.

Figure 2:
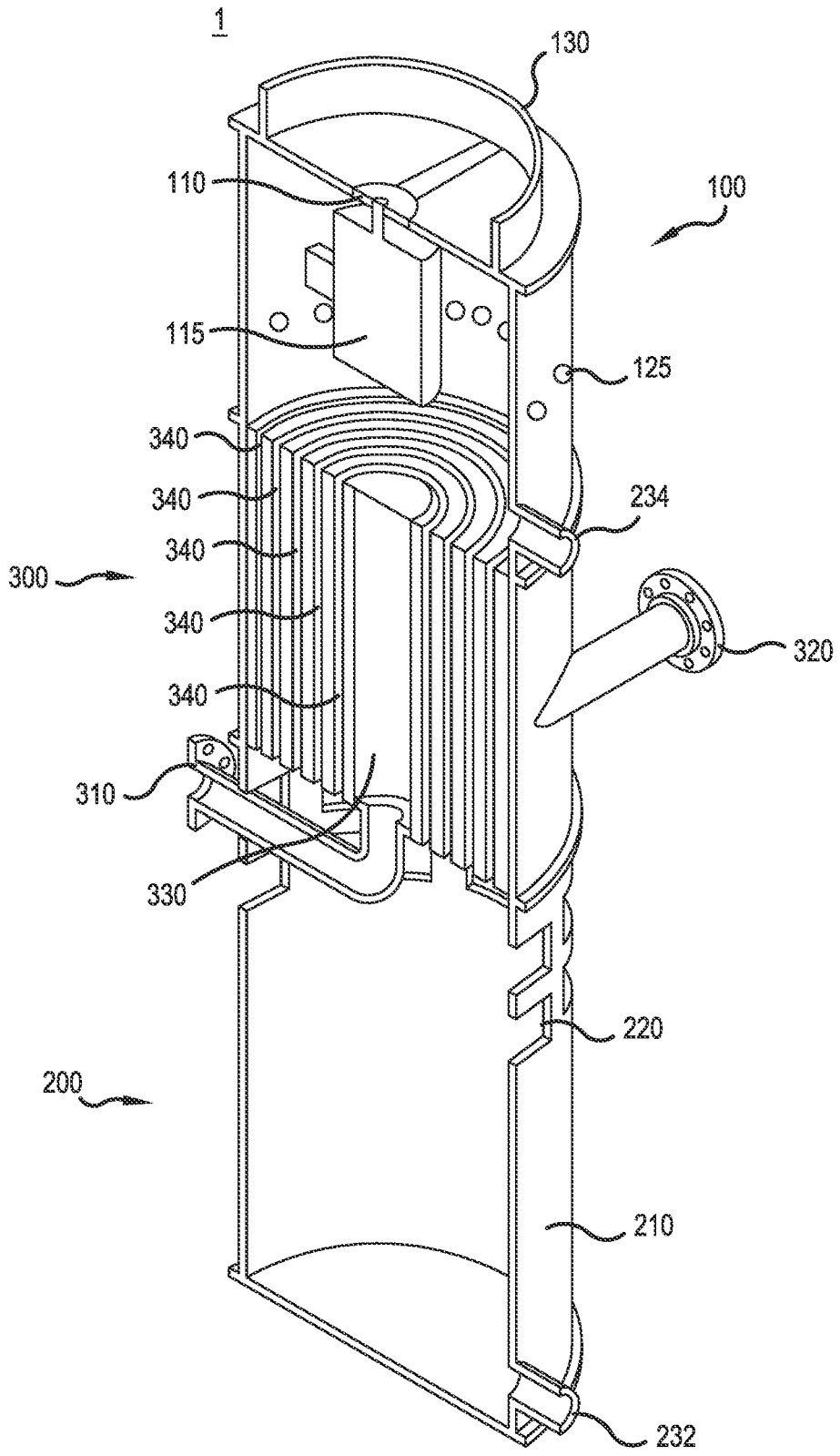
FIG. 2 is a cross-sectional perspective view of the WSAC according to an embodiment of the present invention.
Figure 3:
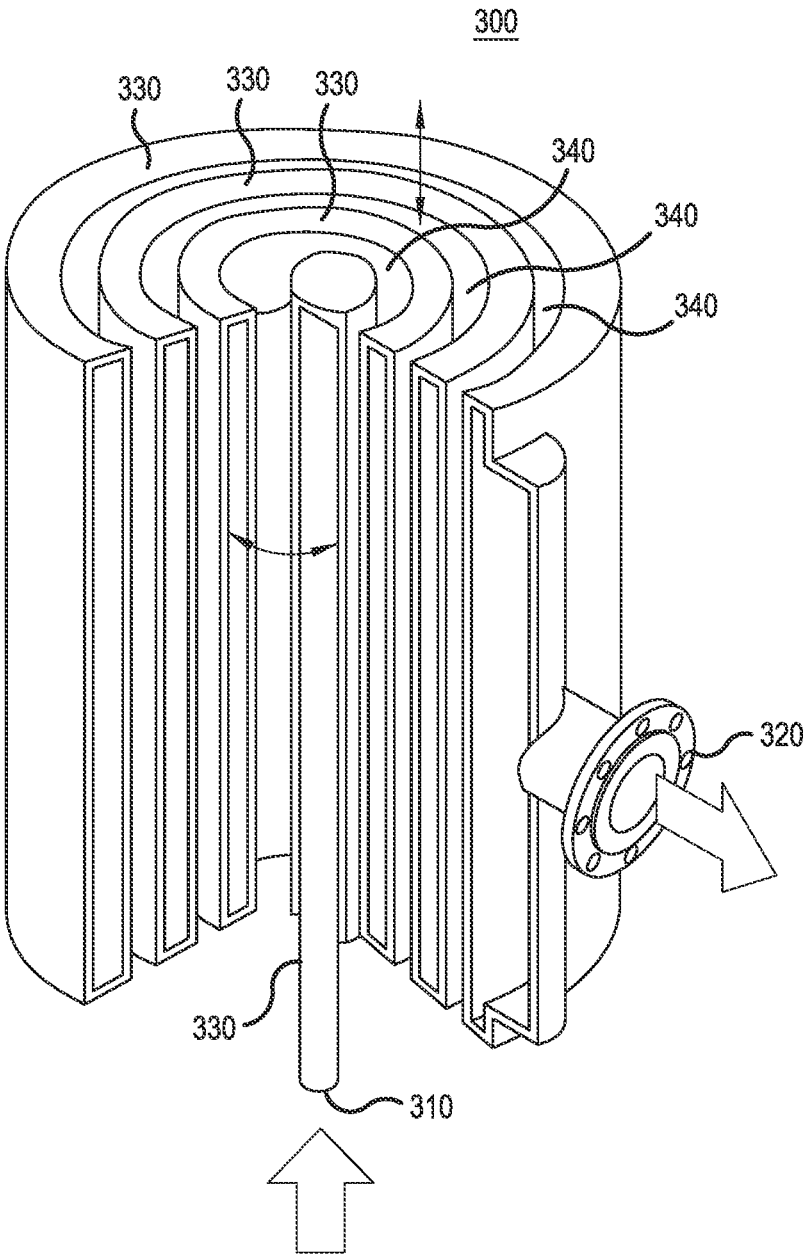
FIG. 3 is a perspective cross-sectional view illustrating the evaporative spiral heat exchanger according to an embodiment the present invention.

FIG. 1 is a cross-sectional view of the WSAC according to an embodiment of the present invention. FIG. 2 is a cross-sectional perspective view of the WSAC according to an embodiment of the present invention. FIG. 3 is a perspective cross-sectional view illustrating the evaporative spiral heat exchanger according to an embodiment of the present invention.

The WSAC 1 according to a first embodiment of the present invention includes an upper module 100, a lower module 200, and an evaporative spiral heat exchanger 300.

The upper module 100 includes a fan 110 (e.g., exhaust fan) having a fan motor 115, a spray system 120 having a plurality of distribution channels 125 and a first passage 130. The fan 110 and fan motor 115 may be provided within a housing of the upper module 100. Further, the center of the fan 110 may be centrally located within the upper housing. The distribution channels 125 may be in the form of nozzles, holes in a slotted pipe, or the like. The spray system 120 may be a concentric spray system 120 and the plurality of distribution channels 125 may be equally spaced from one another along a circumference of the upper module 100 to distribute the cooling medium over (i.e., over the top of) the evaporative spiral heat exchanger 300. Alternatively, the plurality of distribution channels 125 may have any spacing from one another and may be provided on any surface of the upper module 100, so as to distribute the cooling medium over (i.e., over the top of) the evaporative spiral heat exchanger 300.

Each of the upper module 100, the lower module 200 and the evaporative spiral heat exchanger 300 may be provided with flanges to allow for connection between the upper module 100, the lower module 200 and the evaporative spiral heat exchanger 300. The lower module 200 may be a lower housing 200.

The upper module 100 may be removably coupled to a top surface (e.g., a top flange) of the evaporative spiral heat exchanger 300, via fasteners (i.e., bolts, screws, rivets, etc.), and the lower module 200 may be removably coupled to a bottom surface (e.g., a bottom flange) of the evaporative spiral heat exchanger 300, via fasteners (i.e., bolts, screws, rivets, etc.). Further, the evaporative spiral heat exchanger 300 may be vertically stacked onto the lower module 200, and the upper module 110 may be vertically stacked onto the evaporative spiral heat exchanger 300, such that the upper module 100, the lower module 200 and the evaporative spiral heat exchanger 300 are in a vertically stacked configuration, as shown in FIGS. 1 and 2.

The upper module 100 may be removably coupled to the top surface of the evaporative spiral heat exchanger 300 in order to permit easy replacement with another upper module 100 having a different configuration, such as a different height, a different fan size, and/or a different shape. Similarly, the lower module 200 may be removably coupled to the bottom surface of the evaporative spiral heat exchanger 300 in order to permit easy replacement with another lower module 200 having a different number or size of the airflow passages 220, a differently sized basin and/or a different shape.

The WSAC 1, including the upper module 100, the lower module 200 and the evaporative spiral heat exchanger 300, may have a circular cross-sectional shape. The plurality of distribution channels 125 of the spray system 120 may be located around a circumference of the spray system 120 to form a concentric spray pattern, which causes an even distribution of cooling medium onto the evaporative spiral heat exchanger 300. Further, the plurality of distribution channels 125 may be evenly spaced or randomly spaced around the circumference of the spray system 120. The spray system 120 may spray water or any other known cooling medium onto the evaporative spiral heat exchanger 300, to be collected in the basin 210.

Alternatively, the upper module 100, the lower module 200 and the evaporative spiral heat exchanger 300 may have any cross-sectional shape, including any polygonal shape (i.e., rectangular, pentagonal, hexagonal), an elliptical shape, etc.

The lower module 200 includes a basin 210 that collects water sprayed from the spray system 120, one or more airflow passages 220, a pump 230, a first fluid line 232 and a second fluid line 234. The one or more airflow passages 220 may be evenly spaced around a circumference of the lower module 200, and the number of airflow passages 220 and the size of each airflow passage 220 may be modified to optimize air flow through the WSAC 1. Further, FIG. 1 shows the one or more airflow passages 220 positioned at a top portion of the lower module 200, however, the one or more airflow passages 220 may be positioned at any height along the lower module 200.

In a counter-current arrangement of the WSAC 1, the fan 110 draws in air through the one or more airflow passages 220, upwards through the evaporative spiral heat exchanger 300, and out through the first passage 130. That is, the upward direction of airflow through the WSAC 1 is counter to the downward direction of cooling medium sprayed by the distribution channels 125 (i.e., due to the gravity force).

Alternatively, in a co-current arrangement of the WSAC 1, the fan 110 pushes air down from the first passage and down through the evaporative spiral heat exchanger 300, and finally out through the one or more airflow passages 220. That is, the downward direction of airflow through the WSAC 1 is co-current to the downward direction of cooling medium sprayed by the distribution channels 125.

The cooling medium that is collected in the basin 210 is recycled by the pump 230, the first fluid line 232 and the second fluid line 234. Specifically, the collected cooling medium is pumped, by the pump 230, through the first fluid line 232, then through the second fluid line 234 to the spray system 120. The spray system 120, via the distribution channels 125, sprayed the cooling medium onto the evaporative spiral heat exchanger 300 in a continuous manner. That is, the pumped 230 may provide a continuous flow of cooling medium to the spray system 120, and the spray system 120 may continuously spray the cooling medium onto the evaporative spiral heat exchanger 300.

As illustrated in FIGS. 2 and 3, the evaporative spiral heat exchanger 300 includes an inlet 310, and outlet 320, a first channel 330 (i.e., first fluid channel) and second channels 340. The first channel 330 is connected to the inlet 310 and to the outlet 320 and has a spiral configuration (i.e., spiral shaped cross-sectional profile. That is, the first channel 330 begins at a cross-sectional center of the evaporative spiral heat exchanger 300 and spirals radially outward to the outlet 320 of the evaporative spiral heat exchanger 300.

Further, the evaporative spiral heat exchanger 300 may be oriented such that a center axis of the evaporative spiral heat exchanger 300 is along a vertical axis of the WSAC 1, and a radial axis of the evaporative spiral heat exchanger 300 is along a horizontal axis of the WSAC 1.

As illustrated in FIG. 3, shown by the arrows, the evaporative spiral heat exchanger 300 has a cross-flow arrangement in which the direction of air and/or cooling medium flowing through the second channels 340 is cross or perpendicular to the direction of the process medium flowing through the first channel 330.

The evaporative spiral heat exchanger 300 may include a header connected to the outlet 320, as shown in FIG. 3, or may be provided without a header, as shown in FIGS. 1, 2, 4 and 5.

The evaporative spiral heat exchanger 300, including the first channel 330, may be comprised of a metal material, with good thermal conductivity, such as stainless steel, copper, galvanized steel, any other known material. Further, the first channel 330 may radiate heat (i.e., conduct heat) away from the process medium toward the second channels 340. Further, the cooling medium sprayed onto the evaporative spiral heat exchanger 300 is coated along an entire length (i.e., axial length) of the second channels 340 to further conduct heat away from the process medium. Due to the construction of the evaporative spiral heat exchanger 300 with a vertical channel (second channels 340), it allows for a heat exchanger design making optimal use of the available pressure drop while allowing maximum exposure of the airflow and cooling medium to the heat transfer surface, thus improving the thermal dissipation effect of the evaporative spiral heat exchanger 300.

A process medium (e.g., hot process medium) flows through the evaporative spiral heat exchanger 300 by a means known in the art. In the present invention, the process medium flow through the inlet 310, through the first channel 330, and out of the outlet 320. The process medium may be any type of hot process medium as known in the art, such as water, glycol, oil, fuel, gasses or the like, or for condensing steam, ammonia, propylene, butane, or the like.

Further, as shown in FIG. 2, the inlet 310 may extend from outside of the WSAC 1, to the cross-sectional center of the evaporative spiral heat exchanger 300 and the outlet 320 may extend from an outer extent (i.e., outermost radial extent) of the WSAC 1.

FIG. 3 illustrates the evaporative spiral heat exchanger 300 oriented vertically (i.e., in a height direction), in the same manner as shown in FIGS. 1 and 2, such that air flows axially through the evaporative spiral heat exchanger 300, which is caused by the fan 110.

That is, the process medium flows from the inlet 310 located at a cross-sectional center of the evaporative spiral heat exchanger 300 radially outwardly in a spiral manner to the outlet 320, which may be provided at a circumference or outermost radial surface of the evaporative spiral heat exchanger 300. The second channels 340 are located between each wind (e.g., turn) of the first channel 330, to permit airflow around each wind of the first channel 330. That is, the second channels 340 are axial channels that extend in an axial direction (i.e., vertical direction) of the WSAC 1 (and likewise an axial/vertical direction of the evaporative spiral heat exchanger 300). The second channels 340 (or set of second channels 340) may be formed by a single continuous spiral channel 340 extending axially through the evaporative spiral heat exchanger 300, in which each of the second channels 340 may be connected to one another. That is, each portion of the second channel within a respective wind of the first channel may be construed as one of the plurality of second channels.

Alternatively, the outlet 320 may extend from outside of the WSAC 1, from outside of the WSAC 1, to the cross-sectional center of the evaporative spiral heat exchanger 300, and the inlet 310 may extend from an outer extent of the WSAC 1. That is, process medium may flow from the inlet 310 located at an outermost radial extent of the evaporative spiral heat exchanger 300 radially inwardly in a spiral manner to the outlet 320, the outlet 320 being positioned at a radial center of the evaporative spiral heat exchanger 300. The second channels 340 are located between each wind (e.g., turn) of the first channel 330, to permit airflow around each wind of the first channel 330.

Airflow generated by the fan may flow from outside of the WSAC 1 through the one or more airflow passages 220, through the second channels 340, and out through the first passage 130. That is, the fan 110 may pull air through the WSAC 1. Alternatively, the fan 110 may push air through the WSAC 1 by pushing air in from the first passage 130, through the evaporative spiral heat exchanger 300, and out through the one or more airflow passages 220 of the lower module.

The combination of the sprayed cooling medium onto the evaporative spiral heat exchanger 300 (i.e., the second channels 340), and the airflow through the second channels 340 of the evaporative spiral heat exchanger 300 causes the cooling medium on the second channels 340 evaporate, which further increases the thermal conductivity of the evaporative spiral heat exchanger 300. That is, the evaporative spiral heat exchanger 300 is exposed to cooling medium sprayed thereon by the spray system 120, vapor in the form of evaporated cooling medium, and airflow via the fan 110 through the airflow passages 220.

The spray system 120 of the present invention keeps a surface (i.e., vertical surface) of the second channels 340 coated with the cooling medium (i.e., wet) to improve the wetting of the evaporative spiral heat exchanger 300 and thus the cooling effect from the spray system 120.

This evaporative effect of the present invention improves the dissipation of heat from the process medium, thereby improving the efficiency of the WSAC 1. Due to the improved thermal efficiency, the WSAC 1 according to the present invention can have a reduced footprint (i.e., a reduced diameter). Further, the vertically stacked configuration of the WSAC 1, including the circular cross section for the upper module 100, the lower module 200 and the evaporative spiral heat exchanger 300 according to the present invention, results in a reduced pressure loss on the fan side of the WSAC 1 (i.e., at the first passage 1300, to enhance the efficiency of the WSAC 1).

That is, the spiral shape of the evaporative spiral heat exchanger 300 allows airflow axially therethrough (i.e., through the second channels 340) and cooling medium to be sprayed thereon to contacts an entire axial length of each second channel 340. The contact of water with the entire axial length of the second channel 340 improves the cooling effect of the process medium.

Figure 4:
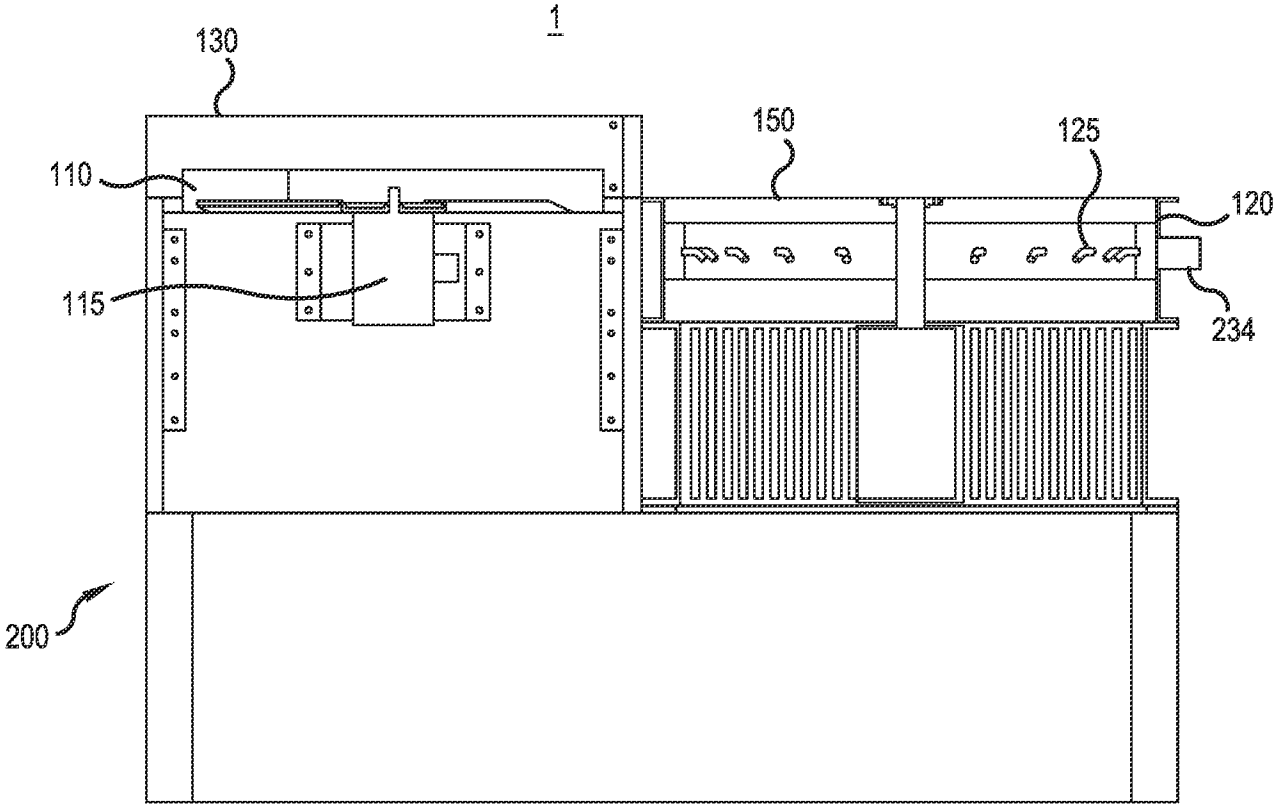
FIG. 4 is a cross-sectional view of the WSAC according to an embodiment of the present invention.
Figure 5:
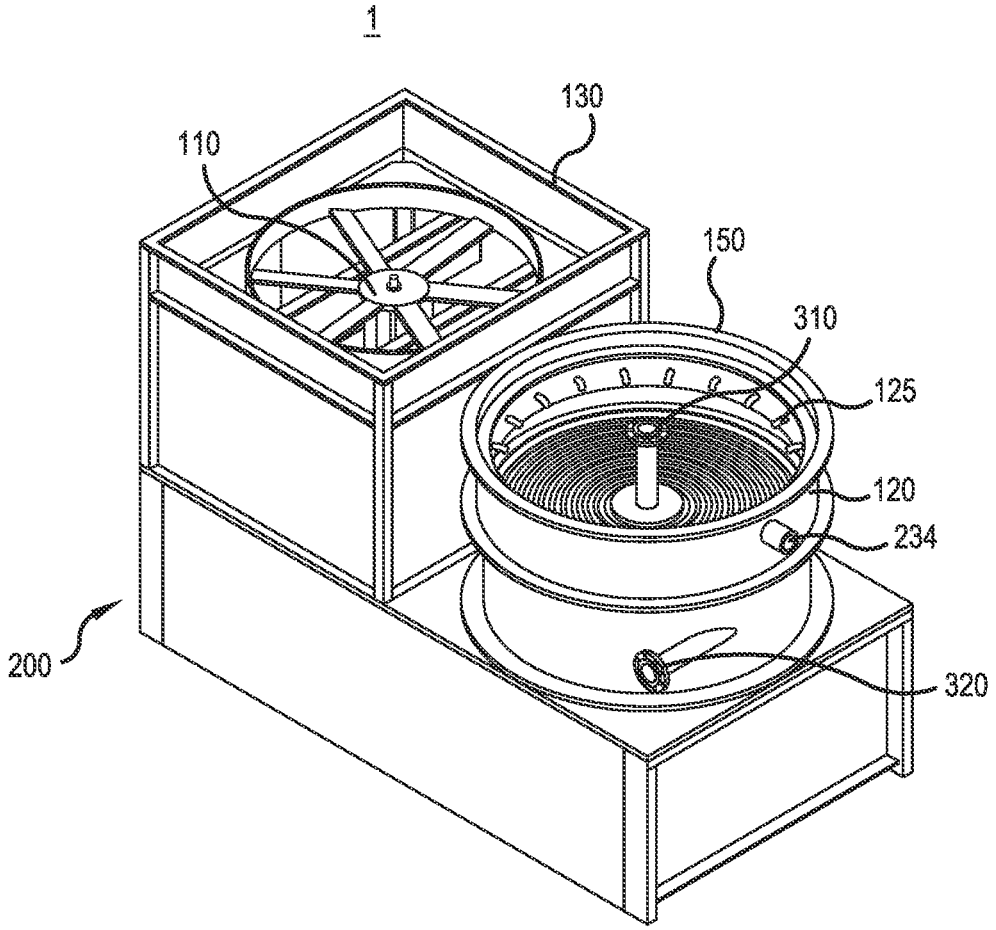
FIG. 5 is a perspective view of the WSAC according to an embodiment of the present invention.

FIGS. 4 and 5 are directed to an alternate embodiment of the present invention in which the fan 110 is spaced apart in a horizontal direction from the spray system 120, and each of the fan 110 and the spray system 120 are mounted onto the basin 210.

The embodiment of FIGS. 4 and 5 also includes the evaporative spiral heat exchanger 300 with the same structure and orientation as shown in FIGS. 1-3. Further, the embodiment of FIGS. 4 and 5 operates in a similar manner to the embodiment of FIGS. 1-3, with the difference mainly being the location of the fan 110 relative to the evaporative spiral heat exchanger 300.

Further, instead of having air passages, the embodiment of FIGS. 4 and 5 includes a second passage 150 positioned at a top surface of the spray system 120, in order to introduce air into the WSAC 1 or to expel air out of the WSAC 1.

As in the embodiment of FIGS. 1 and 2, cooling medium collected in the basin 210 of the lower module 200 is pumped, by the pump 230, back to the spray system 120 via the first and second fluid lines 232, 234.

The WSAC 1 of FIGS. 4 and 5 can operate in a counter-current arrangement, in which the fan 110 draws in air through the first passage 130, down and across the basin 210, upwards through the evaporative spiral heat exchanger 300, and out through the second passage 150. That is, the upward direction of airflow through the evaporative spiral heat exchanger 300 is counter to the downward direction of cooling medium sprayed by the distribution channels 125.

Alternatively, in a co-current arrangement of the present invention, the fan 110 pulls air through the second passage 150, down through the evaporative spiral heat exchanger 300, across the basin 210 and out through the first passage 130. That is, the downward direction of airflow through the evaporative spiral heat exchanger 300 is co-current with to the direction of cooling medium sprayed by the distribution channels 125.

The embodiment of FIGS. 4 and 5 works in a similar manner to that of FIGS. 1-3 above, in that the combination of the sprayed cooling medium onto the evaporative spiral heat exchanger 300 (i.e., the second channels 340), and the airflow through the second channels 340 of the evaporative spiral heat exchanger 300 causes the cooling medium on the second channels 340 evaporate, which further increases the thermal conductivity of the evaporative spiral heat exchanger 300. This evaporative effect improves the dissipation of heat from the process medium, thereby improving the efficiency of the WSAC 1. Due to the improved thermal efficiency of the WSAC 1 according to the present invention can have a reduced footprint.

The spray system 120 may be removably coupled to a top surface of the evaporative spiral heat exchanger 300, as shown in FIGS. 4 and 5. Further, the evaporative spiral heat exchanger 300 may be removably coupled to a top surface of the basin 200. Similarly, the fan 110 may be removably coupled to the top surface of the basin 200 and may be horizontally spaced from the evaporative spiral heat exchanger 300.

Similar to that of FIGS. 1-3 above, the embodiment of FIGS. 4 and 5 may also be modular. The fan 110 may be a first module and the evaporative spiral heat exchanger 300 or the combination of the evaporative spiral heat exchanger 300 with the spray system 120 may be as second module, and the basin may be a third module. The first module, second module, and third module may be replaced with another module having different flow characteristics, including a having a different configuration, such as a different height, a different fan size, and/or a different shape, as known in the art.

As set forth above with respect to the upper module 100, lower module 200 and the evaporative spiral heat exchanger 300, the first module, the second module and the third module may be provided with flanges to allow for connection between the first module, the second module and the third module.

Further, the evaporative spiral heat exchanger 300 may be oriented such that a center axis of the evaporative spiral heat exchanger 300 is along a vertical axis of the WSAC 1, and a radial axis of the evaporative spiral heat exchanger 300 is along a horizontal axis of the WSAC 1.

The present invention is not limited to the examples shown in FIGS. 1-5, and may have different shapes and configurations.

The disclosure of which described above is not limited to the materials and features described therein, and may be changed within the scope of one ordinary skill in the art.

What is claimed is:

1. A wet surface air cooler (WSAC), comprising:

an evaporative spiral heat exchanger including:

a first channel extending substantially an entire height of the evaporative spiral heat exchanger and configured to receive a process medium;

an inlet; and an outlet;

a spray system configured to spray a cooling medium onto the spiral heat exchanger; and a fan configured to force air to flow through the evaporative spiral heat exchanger, wherein the combination of the sprayed cooling medium onto the evaporative spiral heat exchanger and the air flowing through the evaporative spiral heat exchanger causes the cooling medium to at least partially evaporate to cause a temperature of the process medium to decrease and wherein the first channel begins at a cross-sectional center of the evaporative spiral heat exchanger and spirals radially outward to the outlet of the evaporative spiral heat exchanger.

2. The WSAC of claim 1, wherein the first channel of the evaporative spiral heat exchanger has a spiral shape and includes a plurality of winds for flowing the process medium, wherein the evaporative spiral heat exchanger further includes a set of second channels extending axially through the evaporative spiral heat exchanger for receiving air and cooling medium, and wherein each second channel is provided between winds of the first channel.

3. The WSAC of claim 2, wherein the first channel is a closed path extending between the inlet and the outlet and is closed at top and bottom surfaces of the evaporative spiral heat exchanger, and wherein the second channels are open at the top and bottom surfaces of the evaporative spiral heat exchanger.

4. The WSAC of claim 3, wherein the inlet is provided at a radial center of the evaporative spiral heat exchanger and the outlet is provided at an outermost radial surface of the evaporative spiral heat exchanger, or wherein the inlet is provided at the outermost radial surface of the evaporative spiral heat exchanger and the outlet is provided at the radial center of the evaporative spiral heat exchanger.

5. The WSAC of claim 2, wherein the evaporative spiral heat exchanger has a cross-flow arrangement in which a direction of air and/or the cooling medium flowing through the second channels is perpendicular to a direction of the process medium flowing through the first channel.

6. The WSAC of claim 1, further comprising a lower housing including a plurality of airflow passages and a basin, wherein the basin is configured to receive the cooling medium sprayed by the spray system.

7. The WSAC of claim 6, wherein the airflow passages of the lower housing are configured to allow air to flow from inside of the WSAC to outside of the WSAC or from outside of the WSAC to inside of the WSAC.

8. The WSAC of claim 6, wherein the fan is provided above the evaporative spiral heat exchanger, and wherein the evaporative spiral heat exchanger is provided on the lower housing.

9. The WSAC of claim 6, wherein the lower housing is a lower module, and wherein the fan and the spray system are part of an upper module, and wherein the upper module is configured to be removably fastened to an upper surface of the evaporative spiral heat exchanger and the lower module is configured to be removably fastened to a lower surface of the evaporative spiral heat exchanger.

10. The WSAC of claim 1, wherein the fan, the spray system and the evaporative spiral heat exchanger are stacked in a vertical direction.

11. The WSAC of claim 9, wherein the spray system is a concentric spray system including a plurality of distribution channels that are spaced from one another to distribute the cooling medium over the evaporative spiral heat exchanger.

12. The WSAC of claim 1, wherein the fan is horizontally spaced from the evaporative spiral heat exchanger.

13. The WSAC of claim 12, further comprising a lower housing including a basin, wherein the basin is configured to receive the cooling medium sprayed by the spray system, wherein the fan and the evaporative spiral heat exchanger are provided on a top surface of the basin, and wherein the spray system is provided above the evaporative spiral heat exchanger.

14. The WSAC of claim 13, wherein the fan is configured to force air across the basin and through the evaporative spiral heat exchanger or through the evaporative spiral heat exchanger and across the basin.

15. A method of cooling with a wet surface air cooler (WSAC), the WSAC comprising:

an evaporative spiral heat exchanger including:

a first channel extending substantially an entire height of the evaporative spiral heat exchanger and configured to receive a process medium;

an inlet; and an outlet;

a spray system configured to spray a cooling medium onto the spiral heat exchanger; and a fan configured to force air to flow through the evaporative spiral heat exchanger, the method comprising:

flowing the process medium through the first channel; and simultaneously spraying, by the spray system, the cooling medium and operating the fan to flow air through the evaporative heat exchanger and cause the cooling medium to at least partially evaporate and cause a temperature of the process medium to decrease, wherein the first channel begins at a cross-sectional center of the evaporative spiral heat exchanger and spirals radially outward to the outlet of the evaporative spiral heat exchanger.

16. The method of claim 15, wherein the first channel of the evaporative spiral heat exchanger has a spiral shape and includes a plurality of winds for flowing the process medium, wherein the evaporative spiral heat exchanger further includes a set of second channels extending axially through the evaporative spiral heat exchanger, and wherein each second channel is provided between winds of the first channel, the method further comprising, during the simultaneously spraying the cooling medium and operating the fan, flowing the cooling medium and air through the second channels in a same direction or in opposite directions.

17. The method of claim 16, wherein the first channel is a closed path extending between the inlet and the outlet and is closed at top and bottom surfaces of the evaporative spiral heat exchanger, and wherein the second channels are open at the top and bottom surfaces of the evaporative spiral heat exchanger, said method further comprising:

flowing the process medium from a center of the evaporative spiral heat exchanger, radially outwardly through the first channel to an outer surface of the evaporative spiral heat exchanger;

allowing the cooling medium to flow downwardly through gravity; and forcing the air upwardly, opposite to the direction of the cooling medium.

18. The method of claim 16, wherein the first channel is a closed path extending between the inlet and the outlet and is closed at top and bottom surfaces of the evaporative spiral heat exchanger, and wherein the second channels are open at the top and bottom surfaces of the evaporative spiral heat exchanger, said method further comprising:

flowing the process medium from an outer surface of the evaporative spiral heat exchanger, radially inwardly through the first channel to a center of the evaporative spiral heat exchanger;

allowing the cooling medium to flow downwardly through gravity; and forcing the air upwardly, opposite to the direction of the cooling medium.

19. The method of claim 18, wherein the fan and the spray system are part of an upper module, and the WSAC further comprising a lower module including a plurality of airflow passages and a basin, said method further comprising removably fastening the upper module to an upper surface of the evaporative spiral heat exchanger and removably fastening the lower module to a lower surface of the evaporative spiral heat exchanger.

* * * * *